US007355139B1

(12) United States Patent
Yu

(10) Patent No.: US 7,355,139 B1
(45) Date of Patent: Apr. 8, 2008

(54) MINIATURE CIRCUIT BREAKER

(76) Inventor: Tsung-Mou Yu, No. 4, Alley 2, Lane 23, Sec. 3, Pa Te Road, Panchiao, Taipei Hsien (TW)

( * ) Notice: Subject to any disclaimer, the term of this patent is extended or adjusted under 35 U.S.C. 154(b) by 0 days.

(21) Appl. No.: 11/740,290

(22) Filed: Apr. 26, 2007

(51) Int. Cl.
*H01H 5/00* (2006.01)

(52) U.S. Cl. ..... 200/400; 200/405; 337/39

(58) Field of Classification Search ..... 200/400–406, 200/341–345, 520; 337/36, 66, 79, 401–403
See application file for complete search history.

(56) References Cited

U.S. PATENT DOCUMENTS 5,184,269 A * 2/1993 Shimada et al. ..... 361/24
6,057,751 A * 5/2000 Hung et al. ..... 337/377
6,281,780 B1 * 8/2001 Sugiyama et al. ..... 337/137
6,335,500 B1 * 1/2002 Chi et al. ..... 200/341
6,417,756 B1 * 7/2002 Yu ..... 337/66

* cited by examiner

*Primary Examiner*—K. Richard Lee

(57) ABSTRACT

A miniature circuit breaker includes an elastic contact piece to contact with two terminals of a circuit, thereby electrically connecting the circuit. One end of the elastic contact piece fixed to a terminal is a fixed end, and the other end of the elastic contact piece is a free end. The portion of the elastic contact piece close to the fixed end is bended to form an elastic curved section, which is capable of deforming and resuming an original state after deformation. Because of the elastic curved section, the elastic contact piece is capable of deforming, deflecting, and resuming the original state after deformation. Therefore, the length and size of the elastic contact piece can be reduced, and the circuit breaker is miniaturized.

8 Claims, 4 Drawing Sheets

MINIATURE CIRCUIT BREAKER

BACKGROUND OF THE INVENTION

1. Field of the Invention

The present invention relates to a miniature circuit breaker, in which an elastic contact piece connects two terminals of a circuit, thereby electrically connecting the circuit. One end of the elastic contact piece is fixed and bended to form an elastic curved section. The elastic curved section reduces the length of the elastic contact piece, thereby effectively reducing the size of the elastic contact piece. Thus, the objective to miniaturize the circuit breaker is achieved.

2. The Prior Arts

Generally, in a large-scale electric circuit loops, individual circuit loop uses fuses, circuit breakers or thermal circuit breakers to protect the circuit from overload or overheat that cause a fire, thereby providing a level of safety against overload conditions.

Some electronic or electrical appliances, such as high-end electronics, data processors, power consuming heaters, etc, include thermal circuit breakers at power cords or inside the appliances as circuit protection. The thermal circuit breakers interrupt the electric current when the current is excessive or the circuit is overheated. Thus the thermal circuit breakers prevent the electronic or electrical appliances from being burned up when the current of the electronic and electrical appliances is over-loaded. In the same time, the thermal circuit breakers prevent the overload conditions of a single electronic or electrical appliance from causing overload of the individual circuit loop or the whole circuit loops, which results in failures of other appliances in the individual circuit loop or the whole circuit loops.

The conventional thermal circuit breakers in single electronic appliance as described above uses an elastic contact piece to connect with two terminals for connecting the circuit loop. The elastic contact piece of the conventional thermal circuit breaker deforms and flips backward to cut off the circuit loop as the circuit is overheated. The conventional thermal circuit breaker can automatically break off the circuit when the wire is over heated. However, it has many disadvantages as follows.

First of all, the concave or convex elastic contact piece of the conventional thermal circuit breaker would deform, and respectively flip into convex or concave shape after heated. No matter the elastic contact pieces are punched or assembled to form the curved shape, it is hard to keep every elastic contact piece with the same thickness, curvature and structural characteristics. Therefore, it is difficult to precisely control the responsive temperature to break off the circuit. That is, the responsive temperature has great error, and quality control in manufacturing the elastic contact pieces is a difficult task.

Secondly, the curved elastic contact piece of the conventional thermal circuit breaker is not sensitive to the responsive temperature to deform and flip after heated, so it can not protect the electrical appliances from overload or overheat in time.

Thirdly, because length and size of the elastic contact pieces can not be reduced, the size of the conventional thermal circuit breakers is rather big and incapable of being miniaturized. The large circuit breakers not only increase the sizes of the electrical appliances, but also ruin the aesthetics of the appliances.

The amount of material and the manufacturing cost for the thermal circuit breakers can not be reduced.

SUMMARY OF THE INVENTION

An objective of the present invention is to overcome the disadvantages of conventional thermal circuit breakers having a curved elastic contact piece. For example, the responsive temperature of the elastic contact piece to flip after heat deformation can not be effectively controlled; the preset responsive temperature has big error; it is difficult to control the product quality; the elastic contact piece is not sensitive to the responsive temperature so that it can not break off the circuit in time to protect the electrical appliance from overload or overheat; the size of the elastic contact piece can not be reduced, and thus the size of the conventional thermal circuit breaker can not be reduced; The amount of material and the product cost for the thermal circuit breaker can not be reduced.

A miniature circuit breaker according to the present invention is provided with an elastic contact piece to connect with two terminals, thereby electrically connecting the circuit. One end of the elastic contact piece is a fixed end that is fixed to one of the terminal, and the other end of the elastic contact piece is a free end. The portion of the elastic contact piece closed to the fixed end bends and extends to form an elastic curved section. Because the elastic contact piece includes the elastic curved section, elasticity of the elastic contact piece enables itself to extend and deflects outward after heated.

The miniature circuit breaker according to the present invention comprises the elastic contact piece that extends to form the elastic curved section. Because the elastic curved section is elastic, the elastic curved section deforms and deflects after heated. Length and size of the elastic contact piece are reduced, so the objective to miniaturize the circuit breakers is achieved.

Another objective of the present invention is to ensure that the elastic contact piece absolutely disconnects the circuit. That is, the circuit loop is in an absolute shut-off state. In order to achieve the objective, the elastic contact piece is provided with the elastic curved section, which has a function of displacement magnification. When the elastic curved section is heated and deformed, an arc center of the elastic curved section is the rotation axis and the elastic curved section moves a small angle. The small angular displacement results in a relative large displacement of the free end of the elastic contact piece.

A further objective of the present invention is to effectively control the responsive temperature of the elastic contact piece after the elastic contact piece is heated and deformed. Thus the precision of the predetermined responsive temperature improves, and quality control becomes easier. In order to achieve the objective, the elastic contact piece according to the present invention is provided with the elastic curved section. The elasticity of the elastic curved section enables the elasticity contact piece to deform and deflect. The elastic contact piece according to the present invention is unlike a conventional one, which is punched or assembled to form a curved shape. The conventional elastic contact piece deforms and flips backward (from concave to convex or from convex to concave) after heated.

A still further objective of the present invention is to simplify the structure, make manufacturing easier, miniaturize the circuit breaker, reduce the numbers of components, and lower the product cost. The solution of the present invention is to equip the elastic contact piece with the elastic curved section. The elasticity of the elastic curved section enables the elastic contact piece to deflect and resume to the original state.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
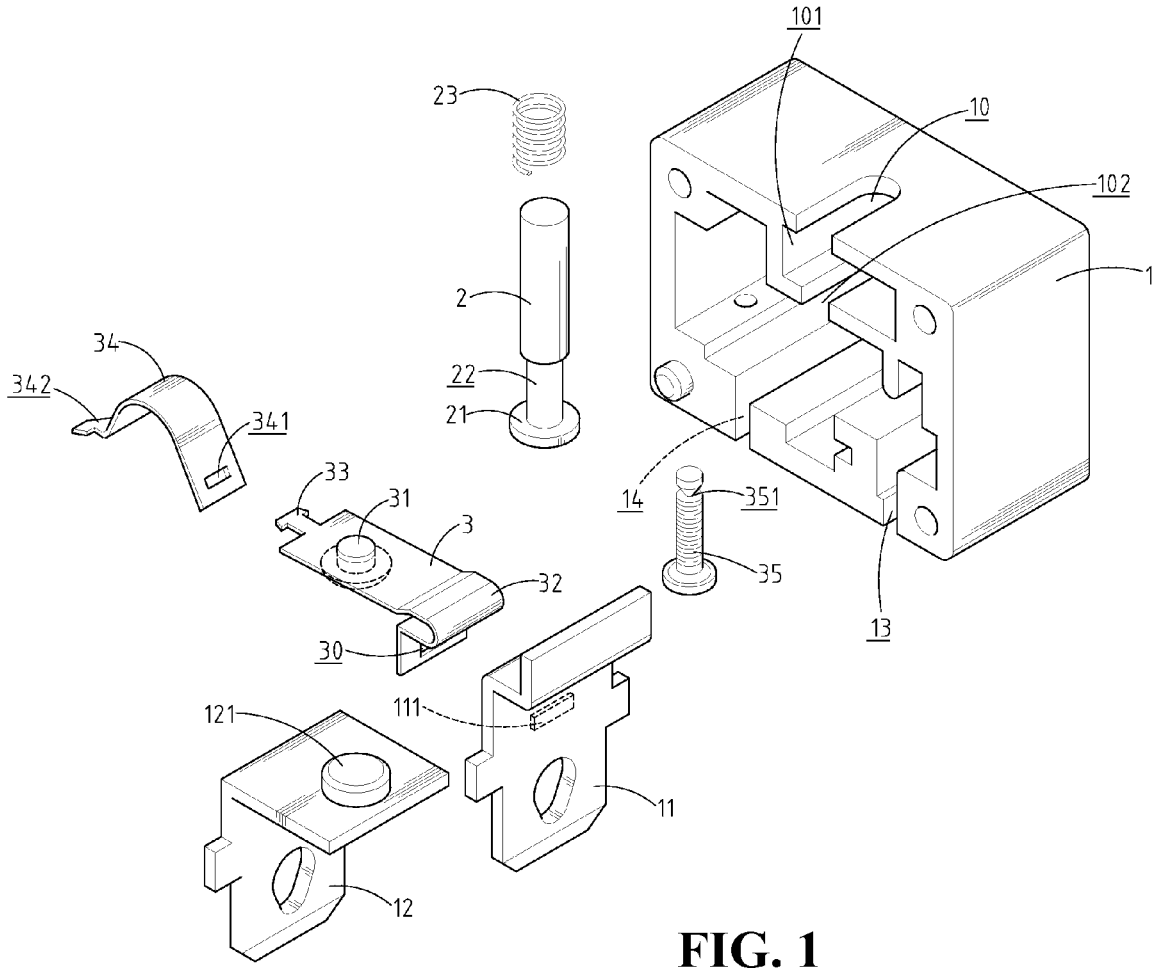
FIG. 1 is an exploded view showing a miniature circuit breaker according to an embodiment of the present invention.

With reference to FIG. 1, a miniature circuit breaker according to an embodiment of the present invention includes a housing 1, a push button 2, and an elastic contact piece 3.

The hollow housing 1 comprises a groove 10, at least two contact terminals (a first contact terminal 11, and a second contact terminal 12), a first slot 13, and a second slot 14. The groove 10 includes an upper notch 101 and a lower notch 102 at upper and lower parts thereof, respectively. The first contact terminal 11 and the second contact terminal 12 according to the embodiment of the present invention are respectively inserted into the first slot 13 and the second slot 14 disposed at the bottom of the housing 1. The upper part of the first contact terminal 11 is bended and fixed to one end of the elastic contact piece 3 and the lower part of the first contact terminal 11 has a raised portion 111. The upper surface of the second contact terminal 12 includes a second contact point 121.

The push button 2 is a rod and includes an enlarged end 21 in a disk shape at the bottom thereof. Other more, the push button 2 has a button neck portion 22, whose diameter is smaller than that of the rod of the push button 2. An elastic member 23 sleeves on the button neck portion 22 of the push button 2. In the embodiment, the elastic member 23 is a helix spring. When the circuit breaker is assembled, the push button 2 is movably inserted in the upper notch 101 of the groove 10 of the housing 1 and the button neck portion 22 of the push button 2 is movably inserted in the lower notch 102. Furthermore, the elastic member 23 is disposed between the lower notch 102 and the enlarged end 21. The push button 2 can move up and down between the upper notch 101 and the lower notch 102 of the groove 10, and contact with the top surface of the elastic contact piece 3.

Figure 2:
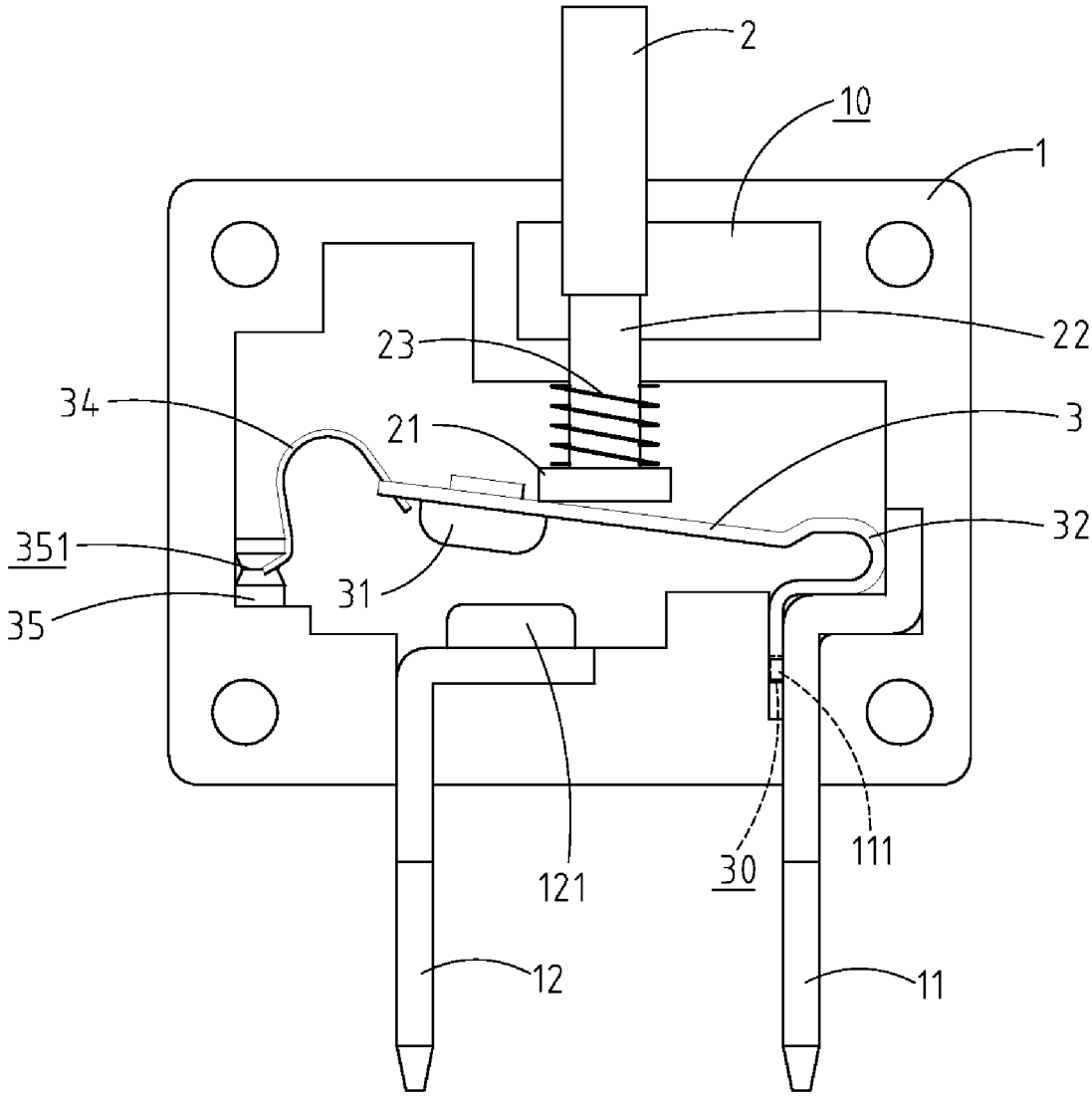
FIG. 2 is a schematic cross-sectional view showing the miniature circuit breaker according to the present invention in OFF state.
Figure 3:
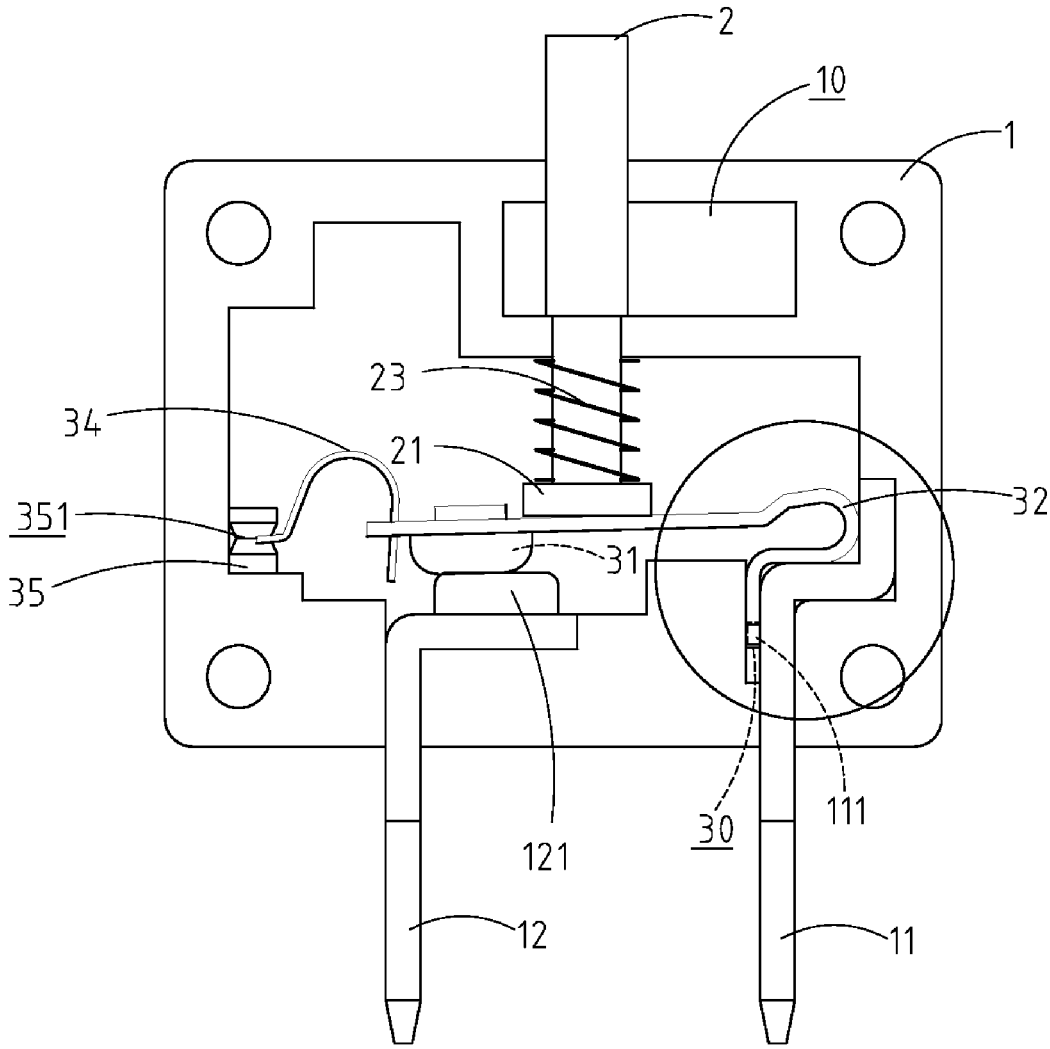
FIG. 3 is a schematic cross-sectional view showing the miniature circuit breaker according to the present invention in ON state.

Generally, the elastic contact piece 3 is a bended strip. The lower end of the elastic contact piece 3 is a fixed end that is fixed to the first contact terminal 11. Referring to FIGS. 2 and 3, the fixed end of the elastic contact piece 3 according to the embodiment of the present invention includes a through hole 30. The raised portion 111 of the first contact terminal 11 engages with the through hole 30 of the elastic contact piece 3, and both the elastic contact piece 3 and the first contact terminal 11 are then disposed in the first slot 13 of the housing 1. Moreover, the other end of the elastic contact piece 3 is a free end, and includes a first contact point 31. A side of the elastic contact piece 3 close to the fixed end extends and bends to form a U-shaped elastic curved section 32. The opening of the U shape is toward the free end of the elastic contact piece 3. When the elastic contact piece 3 is heated, the elastic curved section 32 deforms and the elastic contact piece 3 deflects to break off the circuit. When the elastic contact piece 3 is cooled down, the elastic curved section 32 resumes its original state and the elastic contact piece 3 connects the circuit again. When the elastic contact piece 3 deforms, an arc center of the elastic curved section 32 is a rotation axis and the elastic curved section 32 opens or closes an angle. When the elastic curved section 32 opens or closes a small angle, the first contact point 31 close to the free end of the elastic contact piece 3 moves a relative large distance due to the geometric relationship of the elastic contact piece 3. Also, the elastic contact piece 3 may be a strip made of one of metal alloy, composite metal, and bimetal.

The fixed end of the elastic contact piece 3 may be directly riveted with the first contact terminal 11.

Referring to FIGS. 1, 2, and 3, the free end of the elastic contact piece 3 according to the embodiment of the present invention further comprises a tab 33. One end of an elastic arc piece 34 has an engaging hole 341, which movably engages with the tab 33 of the elastic contact piece 3. The other end of the elastic arc piece 34 has an arc piece groove 342 is movably engaged with a screw neck portion 351 of an adjusting screw 35 disposed in the housing 1. The screw neck portion 351 of the adjusting screw 35 is exposed in the hollow portion of the housing 1. Elasticity of the elastic arc piece 34 is adjusted by displacement of the adjusting screw 35. As the elastic contact piece 3 deflects upward, the elastic arc piece 34 extends and keeps the elastic contact piece 3 in an off state.

FIGS. 2 and 3 show the circuit in the OFF state and the ON state, respectively. Referring to FIG. 3, as the push button 2 is pushed down, the enlarged end 21 of the push button 2 touches and presses the elastic contact piece 3 down. Thus the first contact point 31 of the elastic contact piece 3 moves down to contact with the second contact point 121 of the second contact terminal 12, and the circuit is in an ON state.

Figure 4:
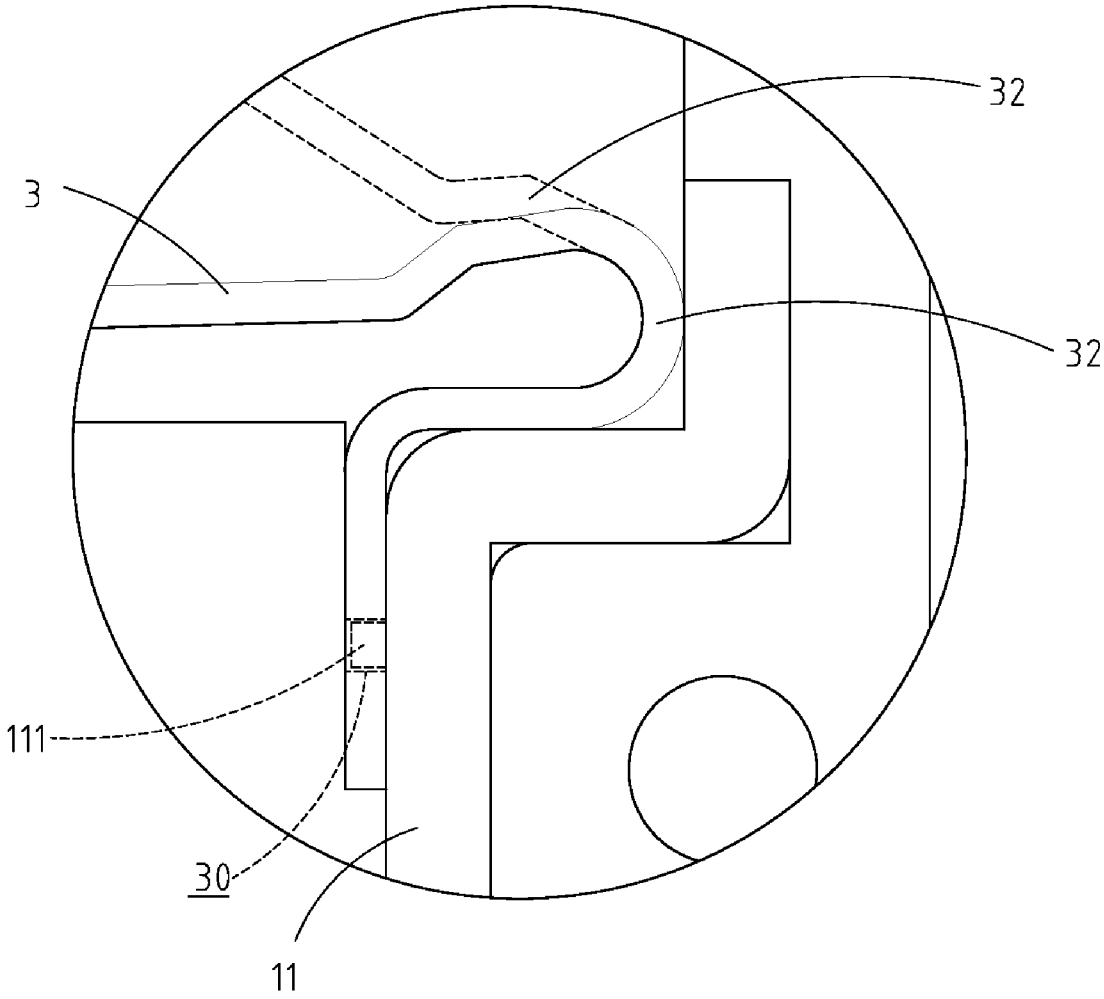
FIG. 4 is a detailed view of the FIG. 3 showing deformation of an elastic contact piece when the circuit is overloaded or overheated.

As the circuit is overloaded or overheated, the elastic contact piece 3 is heated to deformed. Thus, the elastic curved section 32 deforms and moves a small angle. The angular displacement of the elastic curved section 32 causes the free end of the elastic contact piece 3 to move a distance. Referring to FIG. 4, the elastic contact piece 3 extends and deflects upward. Although the angular displacement of the elastic curved section 32 is relative small, the free end of the first contact point 31 moves relatively greater distance upward. The circuit is in an off state, which is shown in FIG. 2. The size of the miniature circuit breaker is small; the elastic curved section 32 enlarges a small angular displacement to a large linear displacement, thereby ensuring the first contact point 31 separates from the second contact point 121. When the circuit is in the OFF state, the first contact point 31 pushes the enlarged end 21 of the push button 2 so as to make the push button 2 move upward.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A miniature circuit breaker, comprising:

a hollow housing including at least two contact terminals, a first contact terminal and a second contact terminal having a second contact point;

an elastic contact piece being a bended strip, whose one end is a fixed end fixed to the first contact terminal and the other end is a free end having a first contact point; and a rod-shaped push button movably inserted in the housing, and contacted with a surface of the elastic contact piece;

wherein the elastic contact piece comprises an elastic curved section close to the fixed end thereof; a U-shaped elastic curved section is capable of deforming and resuming an original state after deformation; when the elastic contact piece is heated, the elastic curved section is deformed, thereby making the elastic contact piece extend and deflect; when the elastic contact piece is heated, the elastic curved section deforms to open an angle using an arc center of the elastic curved section as a rotational axis, and the first contact point at the free end of the elastic contact piece moves a distance, thereby separating the first contact point from the second contact point and ensuring the circuit in an OFF state.

2. The miniature circuit breaker as claimed in claim 1, wherein the elastic curved section is in U shaped and has an opening toward the free end.

3. The miniature circuit breaker as claimed in claim 1, wherein the housing has a groove; an upper part and a lower part of the groove includes an upper notch and a lower notch respectively; the push button comprises a disk-shaped enlarged end at the bottom thereof, and a button neck portion, whose diameter is smaller than that of the rod-shaped push button; an elastic member is disposed around the button neck portion of the push button;

when the push button is assembled with the housing, the push button is movably inserted in the upper notch of the groove on the housing and the button neck portion of the push button is movably engaged with the lower notch and the elastic member is disposed between the lower notch and the enlarged end.

4. The miniature circuit breaker as claimed in claim 3, wherein the elastic member is a helix spring.

5. The miniature circuit breaker as claimed in claim 1, wherein the first contact terminal and the second contact terminal are respectively inserted in a first slot and a second slot at a lower part of the housing.

6. The miniature circuit breaker as claimed in claim 5, wherein both the fixed end of the elastic contact piece and the first contact terminal are inserted and fixed in the first slot at the lower part of the housing.

7. The miniature circuit breaker as claimed in claim 1, wherein the fixed end of the elastic contact piece is directly riveted with the first contact terminal.

8. The miniature circuit breaker as claimed in claim 1, wherein the elastic contact piece is made of one of metal alloy, composite metal, and bimetal.

* * * * *